US005473831A

United States Patent [19]

Locke

[11] Patent Number: 5,473,831

[45] Date of Patent: Dec. 12, 1995

[54] INFORMATION STORAGE AND DISPLAY APPARATUS

[76] Inventor: Michael P. Locke, 7116 Imperial Ridge Dr., El Paso, Tex. 79912

[21] Appl. No.: 271,253

[22] Filed: Jul. 7, 1994

Related U.S. Application Data

[63] Continuation of Ser. No. 49,319, Apr. 21, 1993, abandoned.

[51] Int. Cl.[6] ..... G09F 11/00

[52] U.S. Cl. ..... 40/490; 40/491; 116/321; 116/323; 434/405

[58] Field of Search ..... 40/475, 486, 488, 40/490, 491; 116/321, 322, 323, 324; 434/405

[56] References Cited

U.S. PATENT DOCUMENTS

| | | | |
|---|---|---|---|
| 778,790 | 12/1904 | Merrill | 40/491 X |
| 1,603,847 | 10/1926 | Harper | 40/491 |
| 2,171,873 | 9/1939 | Gould | 40/491 X |
| 2,984,016 | 5/1961 | Nagle | 434/405 |
| 3,505,748 | 4/1970 | Wolfe | 434/405 |
| 4,233,768 | 11/1980 | Bromberg | 40/491 X |

*Primary Examiner*—Brian K. Green

[57] ABSTRACT

A new and improved information storage and display apparatus includes an outer information-bearing member and an inner information-bearing member. The outer information-bearing member and the inner information-bearing member display information relating to exercise routines. The outer information-bearing member includes an array of windows and window-associated informational data. The inner information-beating member includes an array of information fields which contain information data. The information data in the respective information fields are arranged in respective linear stacks. The array of information fields and the linear stacks of information data are arranged such that the information data in the respective information fields are registrable with the array of windows in the outer information-bearing member. In addition, the arrangement of information fields and the linear stacks of information data provide that all corresponding information data in all information fields are incremented in all windows simultaneously when one information data in one information field on the inner information-bearing member is incremented with respect to one window in the outer information-bearing member.

5 Claims, 5 Drawing Sheets

INFORMATION STORAGE AND DISPLAY APPARATUS

This application is a continuation of application 08/049,319, filed Apr. 21, 1993, now abandoned.

BACKGROUND OF THE INVENTION

1. Field of the Invention

The present invention relates generally to devices for displaying stored information, and more particularly, to an apparatus especially adapted for displaying groups of related information simultaneously.

2. Description of the Prior Art

Many activities that people perform are complicated and remembering many details about complicated activities is often very difficult. To lessen the burden on memory for memorizing large quantities of information, information storage devices have been developed. Such information storage devices span a continuum from very high tech and complex, such as computerized address books, to simply a sheet of paper having written information thereon.

Certain complex activities are especially complex in a requirement that groups of information must be remembered at a time. For example, to do a specific exercise routine, a group of different exercises must be recalled, and the number of repetitions of each routine must be memorized. If there are four exercises in each routine, and there are forty different routines, a person would have to memorize forty groups of four exercises or one hundred and sixty exercises. In this respect, it would be desirable if a device were provided that enabled a person to recall large amounts of grouped information without memorizing all of the information.

As mentioned above, computerized information storage devices are available. However, such devices have a number of drawbacks. They are relatively expensive in comparison with several simple sheets of paper. They require an ability to program the device, a skill which is very difficult for large numbers of people. They are subject to memory loss upon battery failure or high levels of magnetic fields. In this respect, it would be desirable if a device were provided that stored and retrieved large amounts of information and that was not disabled by battery failure or high levels of magnetic fields.

Books or booklets are often used for storing of large amounts of information. However, books are often bulky and often require lots of effort to locate specific information in the book. Often specific information that one desires to retrieve in not specifically mentioned in a table of contents or in an index, and as a result is very difficult to locate in the book. In this respect, it would be desirable if a device were provided that enabled rapid retrieval of stored information without resort to searching through a table of contents or an index of a book.

Often retrieval of items of information that are stored takes on two distinct features. First, there is the recall of a broad concept which may escape one's memory. Then, there is the recall of detailed information relating to the broad concept. In this respect, it would be desirable if a device were provided that is simple, easy to carry, and that provides for both broad concept information and detailed information storage and retrieval.

The following U.S. patents have been uncovered which relate to information storage and retrieval: U.S. Pat. Nos. 3,722,885; 4,775,157; 5,062,645; and Des. 284,878. More specifically, U.S. Pat. No. 3,722,885 relates to an exercise game. U.S. Pat. No. 4,775,157 relates to a card game which includes letters for spelling words. U.S. Pat. No. 5,062,645 relates to a fitness and nutrition game. U.S. Pat. No. Des. 284,878 relates to a card game for the sport of golf.

Although some of the patents cited above disclose cards used for information storage and retrieval, none of the prior art discloses the use of cards to store and retain groups of related information that relate to a complex activity such as exercising.

Most of the prior art in the patents cited above describe game concepts which are highly specific. For example, U.S. Pat. No. 3,722,885 relates specifically to exercise. U.S. Pat. No. 4,775,157 relates specifically to spelling words. U.S. Pat. No. 5,062,645 relates specifically to a fitness and nutrition game. U.S. Pat. No. Des. 284,878 relates specifically to a card game for the sport of golf. In this respect, it would be desirable if a card-based device were provided that was versatile for information storage and display for a number of different and unrelated types of information.

Thus, while the foregoing body of prior art indicates it to be well known to use various devices for information storage and retrieval, the prior art described above does not teach or suggest an information storage and display apparatus which has the following combination of desirable features: (1) enables a person to recall large amounts of grouped information without memorizing all of the information; (2) does not require an ability to program the device; (3) is not subject to memory loss upon battery failure or high levels of magnetic fields; (4) uses cards to store and retain groups of related information that relate to a complex activity such as exercising; (5) is a card-based device that is versatile for information storage and display for a number of different and unrelated types of information; (6) enables rapid retrieval of stored information without resort to searching through a table of contents or an index of a book; and (7) is simple, easy to carry, and provides for both broad concept information and detailed information storage and retrieval. The foregoing desired characteristics are provided by the unique information storage and display apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved information storage and display apparatus which includes an outer information-bearing member and an inner information-bearing member. The outer information-bearing member includes an array of windows and window-associated informational data. The inner information-bearing member includes an array of information fields which contain information data. The information data in the respective information fields are arranged in respective linear stacks. The array of information fields and the linear stacks of information data are arranged such that the information data in the respective information fields are registrable with the array of windows in the outer information-bearing member. In addition, the arrangement of information fields and the linear stacks of information data provide that all corresponding information data in all information fields are incremented in all windows simultaneously when one information data in one information field on the inner information-bearing member is incremented with respect to one window in the outer information-bearing member.

In incrementing the inner information-bearing member with respect to the outer information-bearing member, the outer information-bearing member may be held stationary, and the inner information-bearing member is movable with respect to the outer information-bearing member. The stationary outer information-bearing member may be a flat, tubular jacket. The inner information-bearing member may include a first side containing a first array of information fields and may include a second side containing a second array of information fields. The information data in the first array of information fields is to be accessed before information data in the second array of information fields. The first side and the second side are on opposite sides of the inner information-bearing member.

In accordance with another aspect of the invention, the inner information-bearing member includes a first side containing a first array of information fields, a second side containing a second array of information fields, a third side which contains further information about information data on the first side or the second side, and a fourth side which contains further information about information data on the first side or the second side. The first and second sides of the inner information-bearing member contain arrays of information fields which contain broad concepts, and the third and fourth sides of the inner information-bearing member contain detailed information relating to the broad concepts stored on the first and second sides of the inner information-bearing member. The inner information-bearing member is comprised of a two-sided planar sheet folded into quarter panels, such that one side of each quarter panel corresponds to one of the first, second, third, or fourth sides.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved information storage and display apparatus which has all of the advantages of the prior art and none of the disadvantages.

It is another object of the present invention to provide a new and improved information storage and display apparatus which may be easily and efficiently manufactured and marketed.

It is a further object of the present invention to provide a new and improved information storage and display apparatus which is of durable and reliable construction.

An even further object of the present invention is to provide a new and improved information storage and display apparatus which is susceptible of a low cost of manufacture with regard to both materials and labor, and which accordingly is then susceptible of low prices of sale to the consuming public, thereby making such information storage and display apparatus available to the buying public.

Still yet a further object of the present invention is to provide a new and improved information storage and display apparatus that enables a person to recall large amounts of grouped information without memorizing all of the information.

Still another object of the present invention is to provide a new and improved information storage and display apparatus which does not require an ability to program the apparatus, a skill which is very difficult for large numbers of people.

Yet another object of the present invention is to provide a new and improved information storage and display apparatus that is not subject to memory loss upon battery failure or high levels of magnetic fields.

Even another object of the present invention is to provide a new and improved information storage and display apparatus that uses cards to store and retain groups of related information that relate to a complex activity such as exercising.

Still a further object of the present invention is to provide a new and improved information storage and display apparatus that is card-based and that is versatile for information storage and display for a number of different and unrelated types of information.

Yet another object of the present invention is to provide a new and improved information storage and display apparatus that enables rapid retrieval of stored information without resort to searching through a table of contents or an index of a book.

Still another object of the present invention is to provide a new and improved information storage and display apparatus that is simple, easy to carry, and that provides for storage and retrieval of both broad concept information and detailed information relating to the broad concept information.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
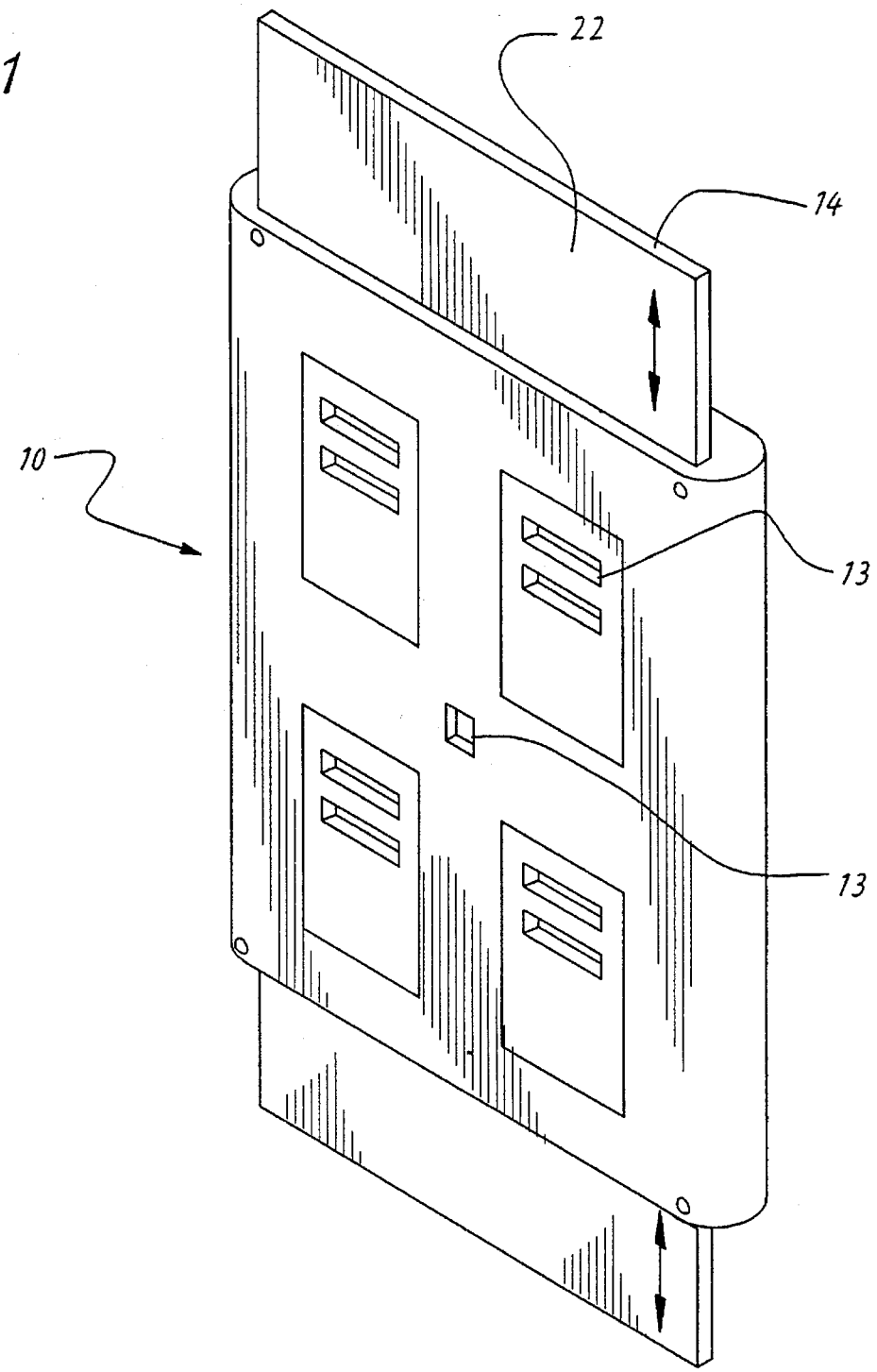
FIG. 1 is a perspective view showing a first preferred embodiment of the information storage and display apparatus of the invention devoid of information.

With reference to the drawings, a new and improved information storage and display apparatus embodying the principles and concepts of the present invention will be described.

Turning initially to FIGS. 1–5, there is shown a first exemplary embodiment of the information storage and display apparatus of the invention generally designated by reference numeral 10. In its preferred form, information storage and display apparatus 10 includes an outer information-bearing member 12 and an inner information-bearing member 14. The outer information-bearing member 12 includes an array of windows 13 and window-associated informational data 15. The inner information-bearing member 14 which includes an array of information fields 16 which contain information data 18. The information data 18 in the respective information fields 16, are arranged in respective linear stacks 20. The array of information fields 16 and the linear stacks 20 of information data 18 on the inner information-bearing member 14 are arranged on the inner information-bearing member 14, such that information data 18 in the respective information fields 16 are registrable with the array of windows 13 in the outer information-bearing member 12. In addition, by incrementing one information data 18 in one information field 16 on the inner information-bearing member 14 with respect to one window 13 in the outer information-bearing member 12, all corresponding information data 18 in all information fields 16 are incremented in all windows 13 simultaneously.

In operation, the outer information-bearing member 12 may be held stationary in one hand of the user, and the inner information-bearing member 14 may be moved with respect to the outer information-bearing member 12 by the other hand of the user. More specifically, the inner information-bearing member 14 can be moved by sliding it inside the outer information-bearing member 12. As shown in FIG. 1, the stationary outer information-bearing member 12 is a flat, tubular jacket. Further information or instructions can be stored on the back side of the tubular jacket.

Figure 3:
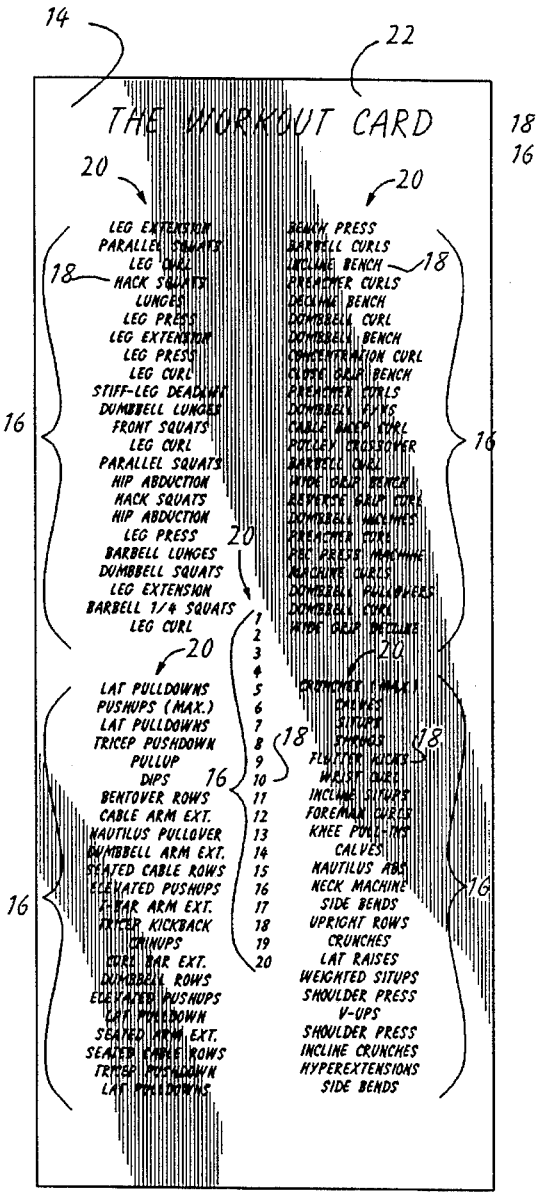
FIG. 3 is a front side of an inner information-bearing member that can be used with the outer information-bearing member shown in FIG. 2.
Figure 4:
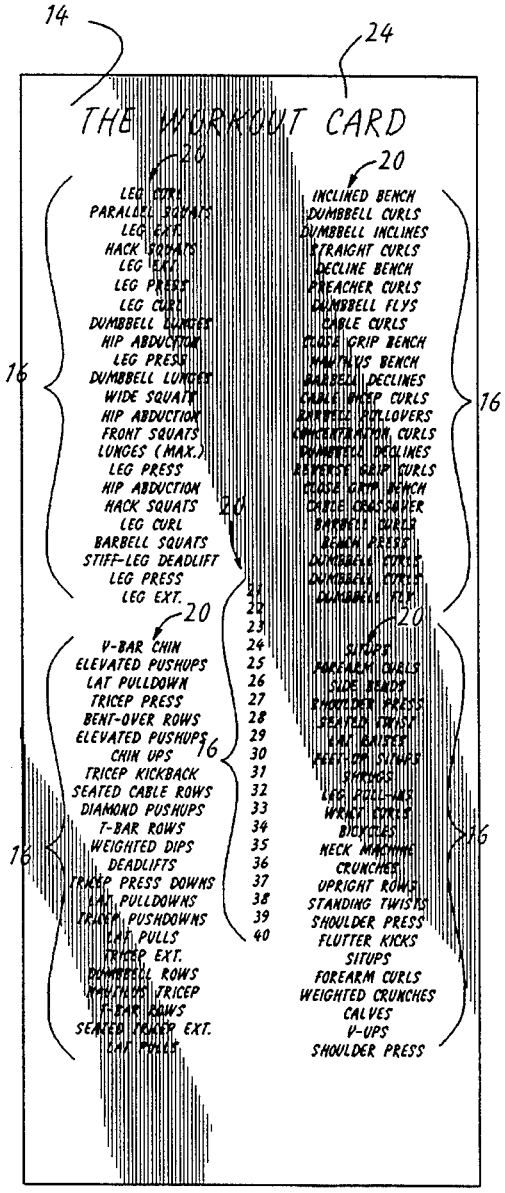
FIG. 4 is a back side of an inner information-bearing member shown in FIG. 3 that can be used with the outer information-bearing member shown in FIG. 2.
Figure 5:
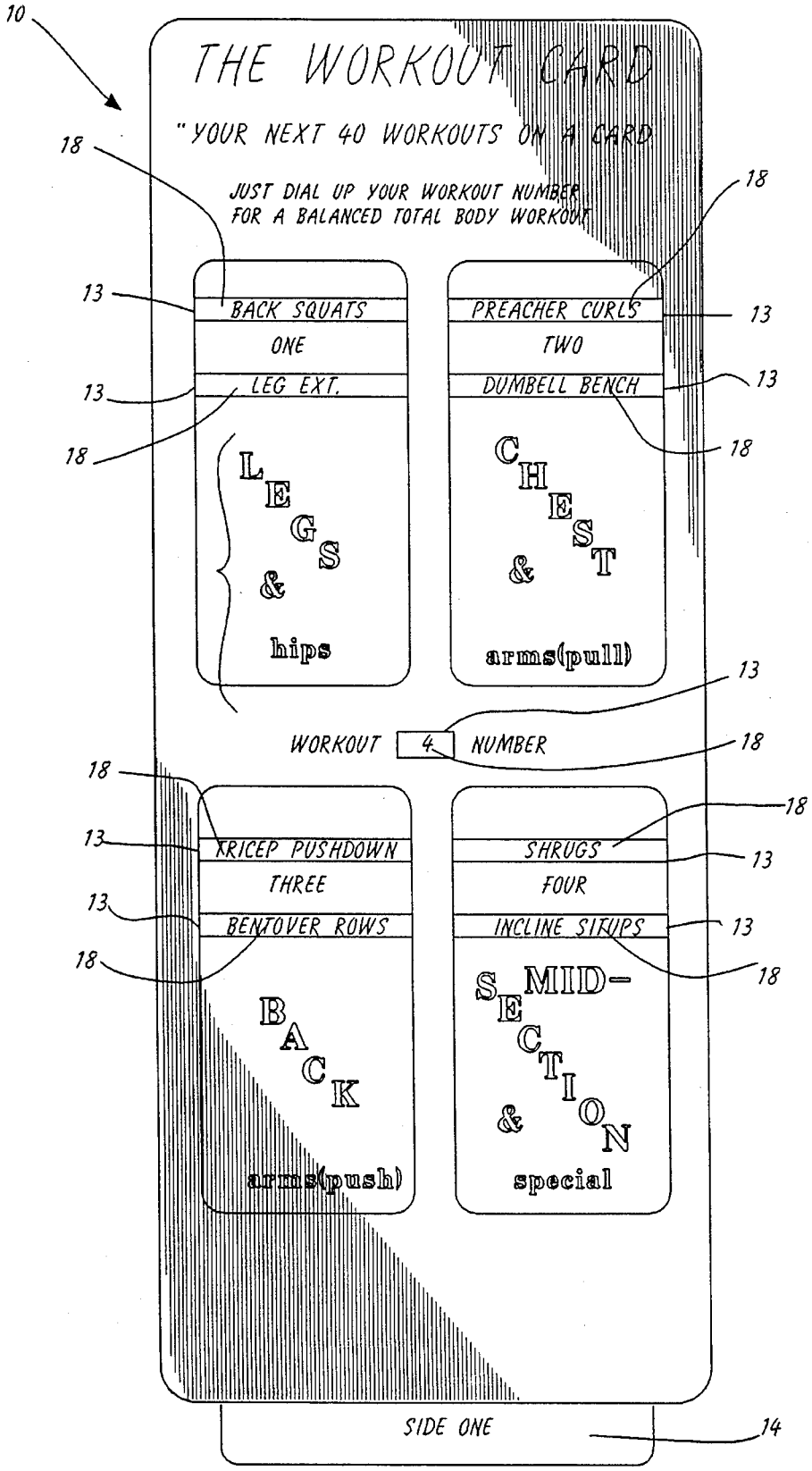
FIG. 5 is a top view of a first preferred embodiment of the information storage and display apparatus of the invention, in accordance with FIG. 1, wherein the group number "4" of the information data of the information fields of the front side of the inner information-bearing member shown in FIG. 3 is placed in registration with the windows in the outer information-bearing member shown in FIG. 2.

As shown in FIGS. 3 and 4, the inner information-bearing member 14 includes a first side 22 containing a first array of information fields 16 and includes a second side 24 containing a second array of information fields 16. The information data 18 in the first array of information fields 16 is to be accessed before information data 18 in the second array of information fields 16. The first side 22 and the second side 24 are on opposite sides of the inner information-bearing member 14. The first array of information fields 16 is on the first side 22 of the inner information-bearing member 14, and the second array of information fields 16 is on the second side 24 of the inner information-bearing member 14.

More specifically, the inner information-bearing member 14 contains forty different workout combinations. Twenty workout combinations are contained on the first side 22, and twenty workout combinations are contained on the second side 24. For each workout combination, four sets of two (that is eight) information data 18 are displayed in the windows 13 of the outer information-bearing member 12. The embodiment of the information storage and display apparatus 10 of the invention shown in FIGS. 1–5 is a simple, two-piece structure.

Figure 6:
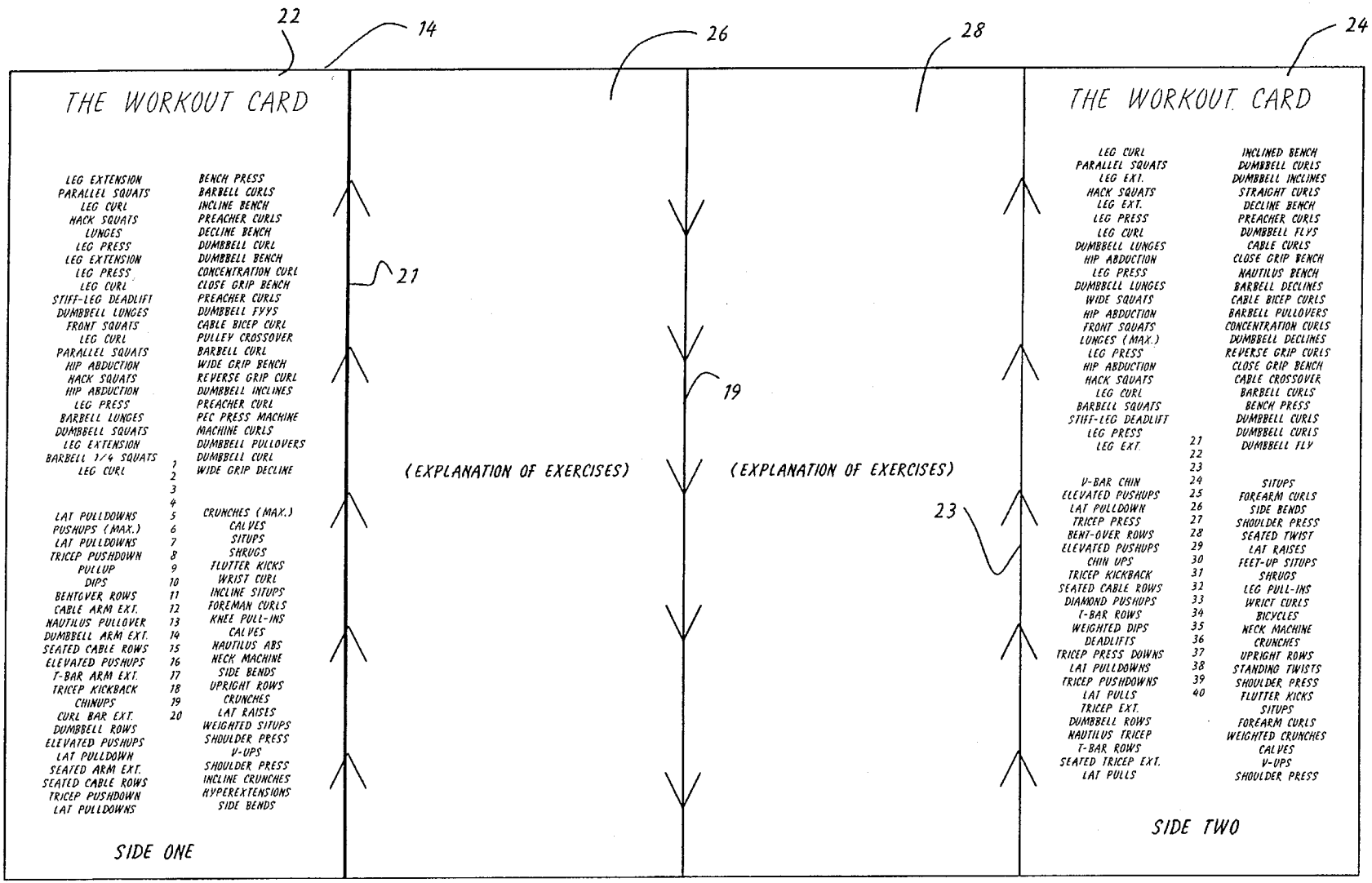
FIG. 6 is a top view of a second embodiment of the inner information-bearing member wherein the first and second sides of the inner information-bearing member contain arrays of information fields which contain broad concepts, and wherein the third and fourth sides of the inner information-bearing member contain detailed information relating to the broad concepts stored on said first and second sides of the inner information-bearing member.

Turning to FIG. 6, a second embodiment of the inner information-bearing member 14 of the invention is shown. Reference numerals are shown that correspond to like reference numerals that designate like elements shown in the other figures. More specifically, the inner information-bearing member 14 includes a first side 22 containing a first array of information fields 16, a second side 24 containing a second array of information fields 16, a third side 26 which contains further information about information data 18 on the first side 22 or the second side 24, and a fourth side 28 which contains further information about information data 18 on the first side 22 or the second side 24.

More specifically, the first and second sides of the inner information-bearing member 14 contain arrays of information fields 16 which contain broad concepts, and the third and fourth sides of the inner information-bearing member 14 contain detailed information relating to the broad concepts stored on the first and second sides of the inner information-bearing member 14.

In FIG. 6, the inner information-bearing member 14 is comprised of a two-sided planar sheet 14 folded into quarter panels, such that one side of each quarter panel corresponds to one of the first, second, third, and fourth sides, respectively. To obtain the quarter panels, 22, 24, 26, and 28, the planar sheet 14 is first folded in half along the fold line 19 between the third quarter panel 26 and the fourth quarter panel 28. In FIG. 6, the fold line 19 is depressed below above the quarter panels 26 and 28.

Then, the first half of the half-folded sheet 14 is folded in half again to provide the two quarter panels 22 and 26. By folding the first half of the half-folded sheet 14 in half again, the additional fold line 21 is created. In FIG. 6, the fold line 21 is elevated above the quarter panels 22 and 26.

Then, the second half of the half-folded sheet 14 is folded in half again to provide the two quarter panels 24 and 28. By folding the second half of the half-folded sheet 14 in half again, the additional fold line 23 is created. In FIG. 6, the fold line 23 is elevated above the quarter panels 24 and 28.

When the planar sheet 14 is folded as described, the first side 22 is the top portion of the inner information-bearing member 14, the second side 24 is the bottom portion of the inner information-bearing member 14, and the third and fourth sides 26 and 28 are sandwiched between the first side 22 and the second side 24. In this folded orientation, the first side 22 and the second side 24 can be used to register the respective information data 18 therein with the windows 13 of the outer information-bearing member 12. In this orientation, however, the contents of the third side 26 and the fourth side 28 are not visible.

Alternatively, to read information on the third and fourth sides 26 and 28, the inner information-bearing member 14 is removed from the outer information-bearing member 12 and unfolded to reveal the third side 26 and the fourth side 28.

Figure 2:
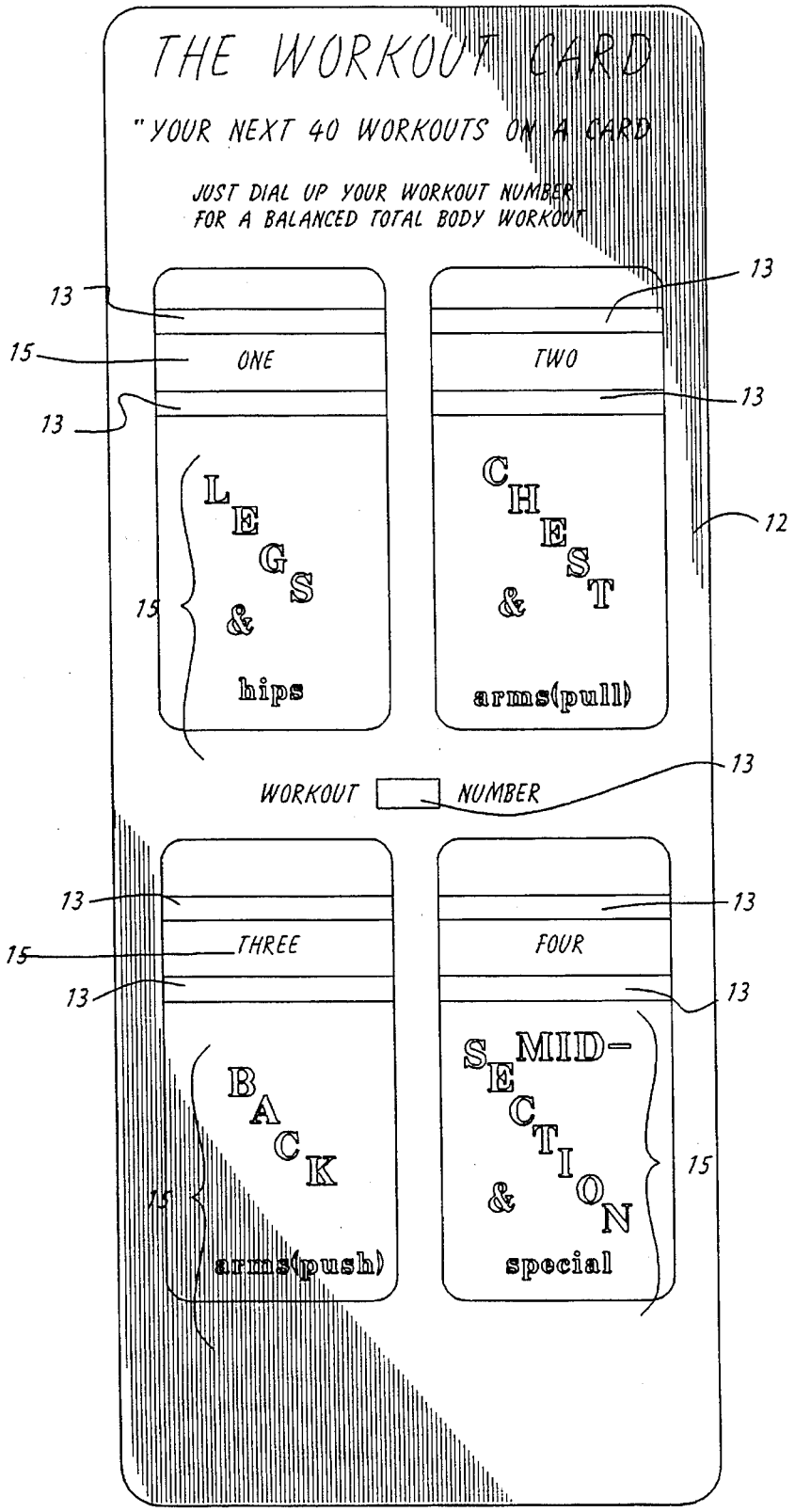
FIG. 2.is a top view of an outer information-bearing member of the invention containing information and windows.

Using the inner information-bearing member 14 shown in FIG. 6 with the outer information-bearing member 12 shown in FIG. 2, a second embodiment of a simple, two-piece structure of the information storage and display apparatus of the invention is obtained.

The components of the information storage and display apparatus of the invention can be made from inexpensive and durable laminated paper or plastic materials.

It is apparent from the above that the present invention accomplishes all of the objects set forth by providing a new and improved information storage and display apparatus that is low in cost, relatively simple in design and operation, and which may advantageously be used to enable a person to recall large amounts of grouped information without memorizing all of the information. Also, with the invention, an information storage and display apparatus is provided which does not require an ability to program the device, a skill which is very difficult for large numbers of people. With the invention, an information storage and display apparatus is not subject to memory loss upon battery failure or high levels of magnetic fields. With the invention, cards are used to store and retain groups of related information that relate to a complex activity such as exercising. With the invention, a card-based apparatus is provided that is versatile for information storage and display for a number of different and unrelated types of information. With the invention, an information storage and display apparatus is provided that enables rapid retrieval of stored information without resort to searching through a table of contents or an index of a book. With the invention, an apparatus that is simple, easy to carry, and that provides for information storage and retrieval of both broad concept information and detailed information relating to the broad concept information.

Additional benefits are obtained by using the information storage and display apparatus of the invention. The need to pre-plan workouts or carry exercise books to the gym are eliminated. The information storage and display apparatus is small and hand-held and is easily carried in a gym bag. Progressive levels and numbers of sets allow the same inner information-bearing member to be used for well over a year.

Moreover, simply by changing the specific information data on the inner information-bearing member, the workout card could be directed to different segments of the exercising population such as: aerobic fitness; teens; the elderly; business travelers; home workouts; etc.

Although the information storage and display apparatus is described above as being useful for storing and displaying broad concepts and detailed information about exercises and workouts, the principles of the information storage and display apparatus can be used for a wide variety of applications. For example, the information storage and display apparatus of the invention can be used for storing and displaying information about meals. Each meal's menu, stored on the first and second sides of the inner information-bearing member, can be registered with the windows on the outer information-bearing member. In this application, recipes and shopping lists can be stored on the third and fourth sides of the inner information-bearing member.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An information storage and display apparatus which stores and displays information related to an exercise routine, comprising:

an outer information-bearing member which includes an array of windows and window-associated informational data relating to different muscle groups in an exercise routine, an inner information-bearing member which includes an array of information fields which contain information data relating to different muscle groups in an exercise routine, wherein said information data in said respective information fields are arranged in respective linear stacks for each respective muscle group, and wherein said array of information fields and said linear stacks of information data on said inner information-bearing member are arranged on said inner information-bearing member, such that information data in said array of information fields are registrable with said array of windows in said outer information-bearing member, and such that incrementing one information data in one information field for one muscle group on said inner information-bearing member with respect to one window in said outer information-bearing member results in all corresponding information data for all muscle groups in all information fields being incremented in all windows simultaneously, wherein said inner information-bearing member includes a first side containing a first array of information fields which contain first-side information data, wherein said first-side information data in said first array of information fields are arranged in respective linear stacks, a second side containing a second array of information fields which contain second-side information data, wherein said second-side information data in said second array of information fields are arranged in respective linear stacks, a third side which contains information relating to said first-side information data or relating to said second-side information data, and a fourth side which contains information relating to said first-side information data or relating to said second-side information data, wherein said first-side information data and said second-side information data contain broad concepts relating to respective muscle groups in an exercise routine, and said third and fourth sides of said inner information-bearing member contain detailed exercise routine information relating to the broad concepts contained in said first-side information data and said second-side information data on said first and second sides of said inner information-bearing member, and wherein said inner information-bearing member is comprised of a two-sided planar sheet folded into quarter panels, such that one side of each quarter panel corresponds to one of said first, second, third, or fourth sides.

2. The apparatus described in claim 1 wherein said outer information-bearing member is stationary and said inner information-bearing member is movable with respect to said outer information-bearing member.

3. The apparatus described in claim 2 wherein said outer information-bearing member is a flat, tubular jacket.

4. The apparatus described in claim 1 wherein said first side of said inner information-bearing member and said second side of said inner information-bearing member are on opposite sides of said inner information-bearing member.

5. A method for storing and displaying information related to an exercise routine, comprising the steps of:

obtaining an outer information-bearing member which includes an array of windows and window-associated informational data relating to different muscle groups in an exercise routine, obtaining an inner information-bearing member which includes an array of information fields which contain information data relating to different muscle groups in an exercise routine, wherein said information data in said respective information fields are arranged in respective linear stacks for each respective muscle group, wherein said array of information fields and said linear stacks of information data on said inner information-bearing member are arranged on said inner information-bearing member, such that information data in said array of information fields are registrable with said array of windows in said outer information-bearing member, and incrementing one information data in one information field for one muscle group on said inner information-bearing member with respect to one window in said outer information-bearing member, whereby all corresponding information data for all muscle groups in all information fields are incremented in all windows simultaneously; and wherein said inner information-bearing member includes:

a first side containing a first array of information fields which contain first-side information data, said first-side information data in said first array of information fields arranged in respective linear stacks, a second side containing a second array of information fields which contain second-side information data, said second-side information data in said second array of information fields arranged in respective linear stacks, a third side which contains information relating to said first-side information data or relating to said second-side information data, and a fourth side which contains information relating to said first-side information data or relating to said second-side information data, wherein said first-side information data and said second-side information data contain broad concepts relating to respective muscle groups in an exercise routine, and said third and fourth sides of said inner information-bearing member contain detailed exercise routine information relating to the broad concepts contained in said first-side information data and said second-side information data on said first and second sides of said inner information-bearing member, and wherein said inner information-bearing member is comprised of a two-sided planar sheet folded into quarter panels, such that one side of each quarter panel corresponds to one of said first, second, third, or fourth sides.

* * * * *